United States Patent [19]

Neri

[11] Patent Number: 4,821,353

[45] Date of Patent: Apr. 18, 1989

[54] BEACH MAT WITH ADJUSTABLE SUN SHADE

[76] Inventor: James Neri, 429 ½ Westbourne, La Jolla, Calif. 92037

[21] Appl. No.: 208,171

[22] Filed: Jun. 17, 1988

[51] Int. Cl.[4] ..... A47G 9/06

[52] U.S. Cl. ..... 5/418; 135/87; 135/116

[58] Field of Search ..... 5/418, 417, 419, 420, 5/414; 135/87, 116, 904

[56] References Cited

FOREIGN PATENT DOCUMENTS

| | | | |
|---|---|---|---|
| 693016 | 8/1931 | France | 5/418 |
| 456325 | 4/1950 | Italy | 5/418 |

*Primary Examiner*—Alexander Grosz

*Attorney, Agent, or Firm*—Selwyn S. Berg

[57] ABSTRACT

A Beach Mat with built-in Adjustable Sun Shade is described. The head of the mat contains elastic stays. These elastic stays permit the head of the mat to be shaped into an arc with the help of strings. Said arc becomes a sun shade. On relief of the tension of the stays by releasing the strings, the mat may be rolled into a small cylinder for transportation and storage.

2 Claims, 2 Drawing Sheets

BEACH MAT WITH ADJUSTABLE SUN SHADE

BRIEF SUMMARY OF THE INVENTION

A popular worldwide recreation involves beach and sun. However, many people who partake of this recreation find the sand of the beach objectionable and the ultra-violet radiation of the sun dangerous. Consequently, people who participate in beach recreation often take with them blankets and sun shades so as to be able to enjoy the beach but curtail the discomforts they find inherent in the recreation. There are many products which have been promoted for the public who take recourse to the beach for fun and recreation. Consequently, most people and families arrive with armfuls of chairs, food and beverage containers, radios, televisions, beach toys, beach games as well as beach blankets and assorted sun shades. It is the objective of this invention to provide both a protection from the sand and a protection from the sun in a single compact package so as to alleviate the recreant from the burden of having to transport to and from the beach separate items. In addition, this beach mat with adjustable sun shade will easily store in a car or even easily attach to a bicycle. The mat in the described embodiment is composed of fiber-like material sections bound together by cord similar to a product which has been generally known as mats or bamboo shades. It is, of course, a tight weave to prevent sand from sifting through. The fiber used in the lateral direction in the mat must have some rigidity to prevent the shading portion of the mat from collapsing. Elastic spines run parallel and at the periphery of the shade section which provides the shaping of the shade into an arc section under which the recreant can lie. Strings are routed through appropriate eyelets in the shade section which adjusts said shade to give the appropriate amount of sun protection. When said strings are pulled to a desired length the mat forms a semi-tube which can be used to enclose a portion of the recreant's body giving complete privacy and maximum shade as well as protection from the beach elements. The mat may be rolled into cylinder thereby occupying minimum space for storage and transport.

DETAILED DESCRIPTION OF THE EMBODIMENT

Figure 1:
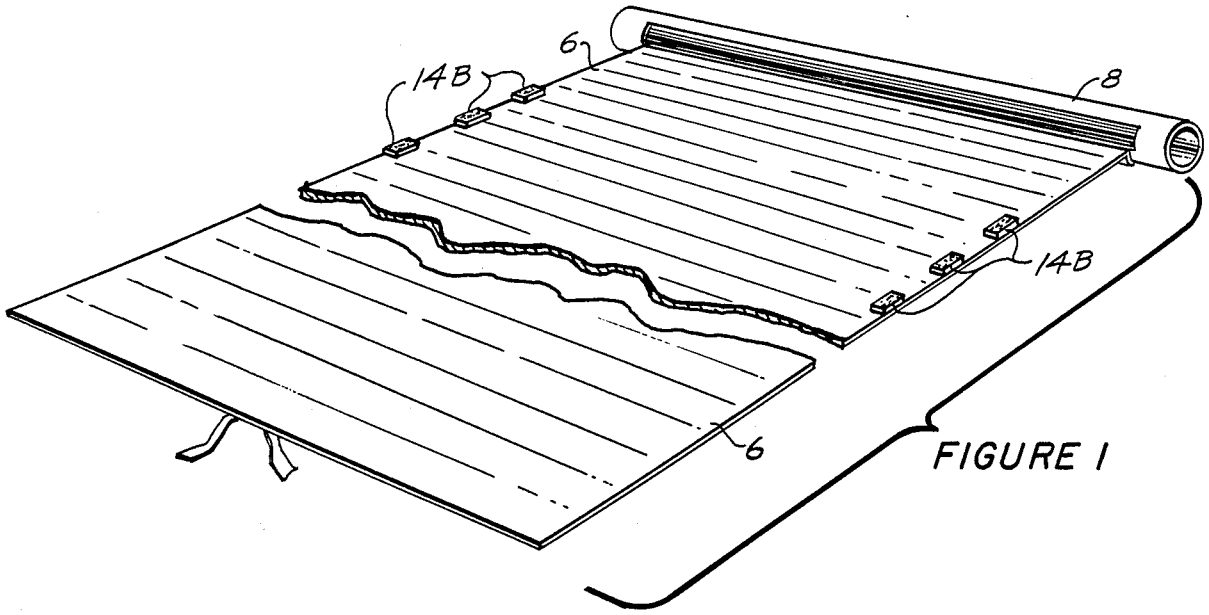
FIG. 1 shows the sunshade mat fully extended.

When the mat is unrolled in its full horizontal position as shown in FIG. 1, one can observe the mat, 6, of an appropriate length and width to accommodate a person. The mat can be of woven grass, plastic or canvas with appropriate rigidity characteristics. At head of the mat is the boom, 8, which is shaped from plastic tubing. The boom imparts rigidity to the head of the mat and serves as a storage for the bows and conduit for the bowstring as will be described later. FIG. 1 also shows the placement of stays, 14,. The stays hold the bow in place along the periphery of the mat.

Figure 2:
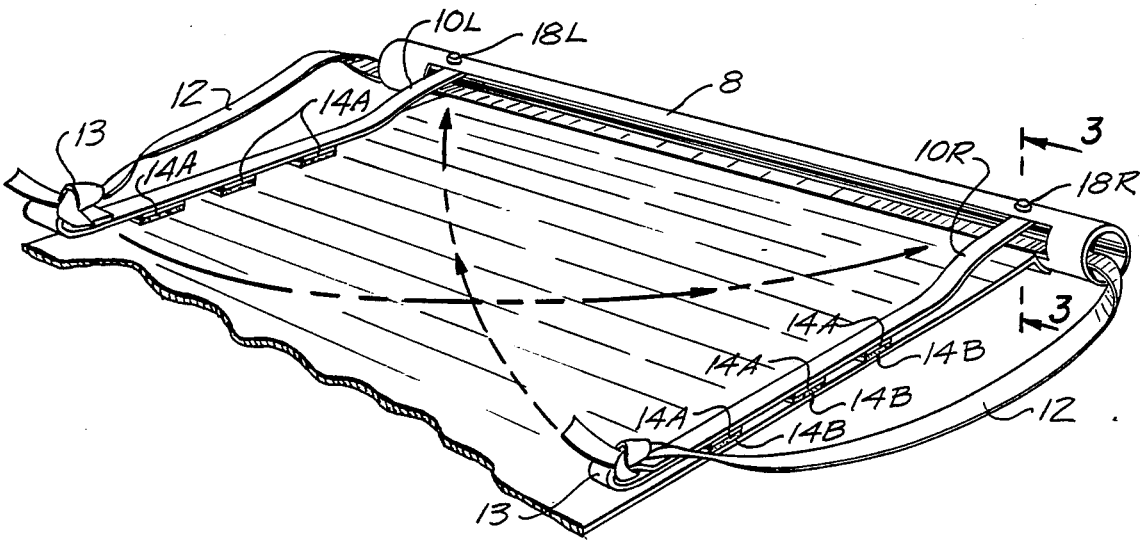
FIG. 2 details the boom assembly with retractable bows extended along the sunshade section.

FIG. 2 is a detail of the boom assembly with the bows extended. The boom, 8, is cut from tube material and has a section removed which stores a right and left bow, 10R and 10L respectively. These bows are retained on pivot means on the left and right hand sides, 18L and 18R respectively, of said boom. Located at the ends and approximately at the one third and two third positions are complimentary stays, 14A, which mate with the stays attached to the mat, 14B. A bowstring, 12, is attached to the end of one bow, 18L,and is threaded through the boom, 8, and then tied in a loop, 13, at the end of the other bow, 18R; the bowstring is made of any durable ribbon. The bows, 10L and 10R are structural spines which may be made of any flexible material such as spring steel, plastic battens, fiberglass or other appropriate plastics which would resist deterioration from the elements found in a beach environment. FIG. 2 shows the shade area of the mat in its extended position; each of the bows are pivoted out from the boom. The stays, 14A and the complementary stays, 14B are mated; the embodiment uses hook and loop type fasteners, such as the ones sold under the Trademark of "VELCRO" which has been appropriately fastened to both the mat and the bows. The bowstring is tied to the ends of the bows and threaded through the boom.

Figure 3:
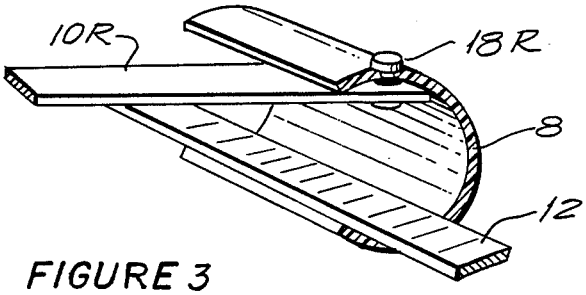
FIG. 3 is a cross section perspective view of the boom assembly.
Figure 4:
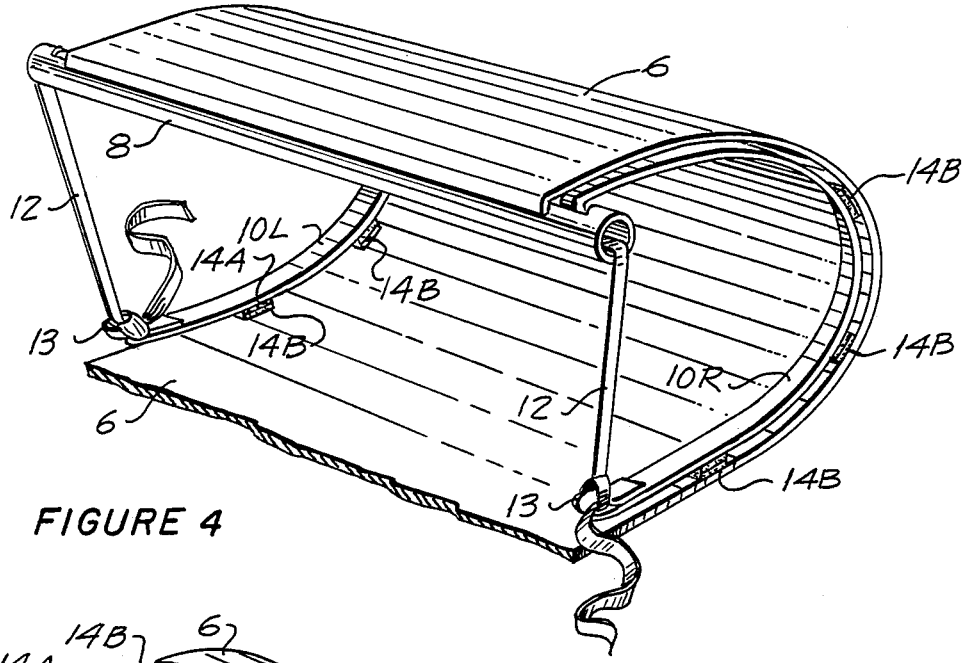
FIG. 4 shows the mat with the erected shade section.

FIG. 3 shows a detailed cross-section of the end of the boom indicating the employment of a rivet as a pivot means, 18L and 18R, holding the bow, 10L and 10R. The bowstring, 12, is also shown routed through said boom, 8. By tightening onto the bowstring, 12, as shown in FIG. 4 the bows are tensioned into an arc of a circle. The distal end of the bowstring is knotted at some appropriate position. The stays are toed inward slightly to provide additional lateral tension to stiffen the shade portion so as to prevent collapse as the bows are pulled into an arc by the bowstring. The bows are held along the periphery of the shade section of the mat by the attachment means of hook and loop type fasteners, such as the ones sold under the Trademark of "VELCRO"

Figure 5:
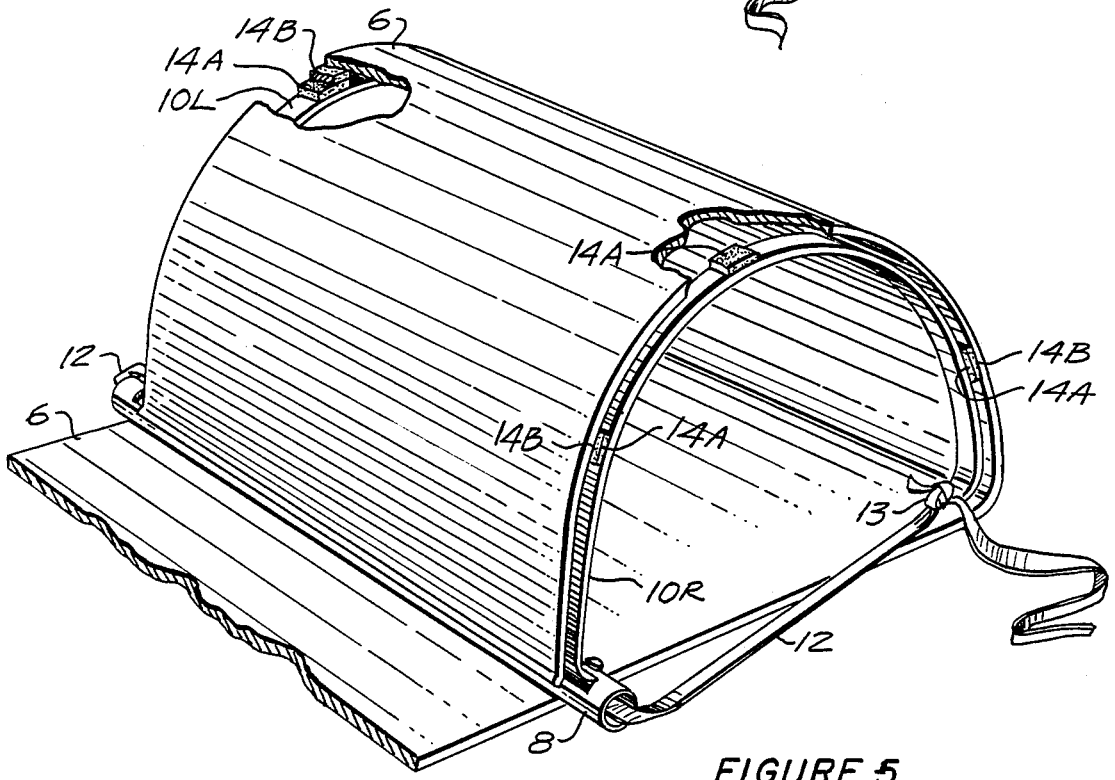
FIG. 5 shows the shade section contoured into the tunnel mode.

By tieing-off an appropriate amount of bowstring the shade section the mat may be appropriately sized into an arc to assure protection from the sun. In addition, the recreant may still have a 180 degree view of the beach. Not illustrated, but also possible, is a configuration that makes the shaded portion into the shape of a section of a truncated cone which permits a larger opening on one side than on the other. There is adequate friction between the bowstring and the boom so one can manually bend one of the bows into a greater curvature than the other so that one side of the shaded section would have a larger diameter than the other. Another useful configuration is shown in FIG. 5 where the shade section is closed over so that the boom, 8, engages the mat creating a tunnel. This mode is useful to protect personal possessions or pets from the sun. It is also very useful to completely protect infants not only from the sand and the sun, but the wind and the noise on the beach as well. In addition, if an owner has more than one of these mats, he could put them together and crawl into the tube to obtain the privacy and protection of a total enclosure.

Figure 6:
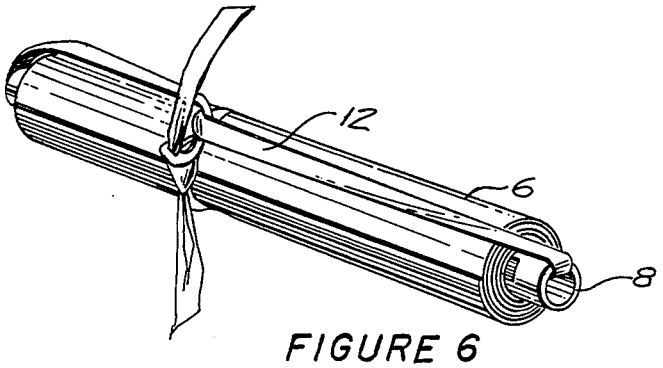
FIG. 6 shows the mat rolled up for transport and storage.

FIG. 6 shows the shade mat rolled up for transport or storage. The tension is removed from the bowstring and the bows become straight and so that the bows may be folded into the boom like closing a jackknife and the mat then rolled around the boom. Appropriate ties may be made on the extension of the bowstring so as to keep the mat from unwrapping and the free length of the bowstring between the edge of the boom and the tie may be used as a carrying handle or a sling placed over the shoulders leaving the hands free.

I claim:

1. A rectangular beach mat with integral sun shade comprising:

a boom of tube stock, two bows of resilient material, and a bowstring, said boom having a slot cut along its length and attached to a top end of a short side of said mat, said bows attached by pivot means in the ends of said boom, mating means and complimentary mating means, where said mating means is attached to said bows at an unpivoted end and at a multiplicity of other positions along the length of said bows, and complimentary mating means attached to said mat in a pattern which tapers slightly inward from each long edge from the top of said mat and positioned to adhere to said mating means on said bow, a multiplicity of loops on said bowstring, one loop on an end, and others along the length of said bowstring, said end loop engaging said unpivoted end of one of said bows and threading through the length of the boom and exiting therefrom;

so that said bows may be mated to said mat with said mating means and complimentary mating means, said bowstring tensioning said bows into arcs thereby creating a canopy of the upper portion of said mat, maintaining said canopy by attaching said loops to said unpivoted ends of said bows and thereby providing a sun shade;

and by releasing said tension in said bowstrings and un-adhering said mating means and complementary mating means, one may jack-knife said bows into said boom and roll said mat to create a compact portable unit.

2. A rectangular beach mat with integral sun shade as described in Claim 1 where the pivoting means is a rivet which penetrates through each end of said boom and the end of said bow.

* * * * *